US011965722B2

(12) United States Patent
Akhmad et al.

(10) Patent No.: US 11,965,722 B2
(45) Date of Patent: Apr. 23, 2024

(54) NON-INCENDIARY TRACERS

(71) Applicant: BAE SYSTEMS plc, London (GB)

(72) Inventors: Mohammed-Asif Akhmad, Chelmsford (GB); Richard Binns, Chelmsford (GB); Daniel Phillip Crane, Chelmsford (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/005,409

(22) PCT Filed: Jun. 30, 2021

(86) PCT No.: PCT/GB2021/051661
§ 371 (c)(1),
(2) Date: Jan. 13, 2023

(87) PCT Pub. No.: WO2022/013522
PCT Pub. Date: Jan. 20, 2022

(65) Prior Publication Data

US 2023/0266107 A1 Aug. 24, 2023

(30) Foreign Application Priority Data

Jul. 16, 2020 (EP) ..... 20275120
Jul. 16, 2020 (GB) ..... 2010965

(51) Int. Cl.
*F42B 12/38* (2006.01)

(52) U.S. Cl.
CPC ..... *F42B 12/382* (2013.01)

(58) Field of Classification Search
CPC ..... F42B 12/38; F42B 12/382; F42B 12/385
See application file for complete search history.

(56) References Cited

U.S. PATENT DOCUMENTS 1,961,076 A * 5/1934 Page ..... F42B 12/78 102/516
3,236,183 A * 2/1966 Littleford ..... F42B 12/38 102/513

(Continued)

FOREIGN PATENT DOCUMENTS

DE 102014111852 A1 2/2016
EP 3457077 A1 3/2019

(Continued)

OTHER PUBLICATIONS

International Search Report and Written Opinion received for PCT/GB2021/051661, dated Sep. 10, 2021. 14 pages.

(Continued)

*Primary Examiner* — Derrick R Morgan
(74) *Attorney, Agent, or Firm* — Finch & Maloney PLLC

(57) ABSTRACT

In some examples, a non-incendiary tracer projectile structure for housing an electrically powered illumination source comprises a jacket comprising a generally pointed forward end and a generally blunt rearward end defining a rear opening, an internal retaining structure disposed towards the rearward end of the jacket to support a protective window that is transparent to a selected electromagnetic wavelength, wherein a portion of the rearward end of the jacket tapers in a radially inward direction whereby to define a circumferential narrowing of the rear opening so configured as to mechanically protect the internal retaining structure.

20 Claims, 4 Drawing Sheets

(56) References Cited

U.S. PATENT DOCUMENTS

| | | | | |
|---|---|---|---|---|
| 3,898,933 | A * | 8/1975 | Castera | F42B 8/16 102/529 |
| 4,528,911 | A * | 7/1985 | DePhillipo | F42B 12/38 102/513 |
| 5,760,329 | A * | 6/1998 | Baum | F42B 12/38 102/513 |
| 6,272,998 | B1 * | 8/2001 | Strandli | F42B 12/38 102/513 |
| 6,497,181 | B1 * | 12/2002 | Manole | F42B 12/40 102/513 |
| 8,007,608 | B1 * | 8/2011 | Herbage | C06C 15/00 149/109.2 |
| 8,342,990 | B1 * | 1/2013 | Price | F42B 12/362 473/570 |
| 8,848,046 | B1 * | 9/2014 | Stofko | F42B 12/365 348/61 |
| 9,500,457 | B1 * | 11/2016 | Horch | F42B 33/02 |
| 10,451,392 | B2 * | 10/2019 | Muster | F42B 12/38 |
| 10,794,674 | B2 * | 10/2020 | Parker | F42B 12/382 |
| 11,808,552 | B1 * | 11/2023 | Italia | F42C 19/083 |
| 2004/0099173 | A1 * | 5/2004 | Rector | F42B 12/382 102/501 |
| 2005/0034627 | A1 * | 2/2005 | Manole | F42B 12/382 102/513 |
| 2010/0285721 | A1 * | 11/2010 | Ma | F42B 8/12 446/485 |
| 2015/0308802 | A1 * | 10/2015 | Chua | F42B 12/382 241/1 |
| 2017/0261370 | A1 * | 9/2017 | Poret | G01P 3/68 |
| 2017/0336185 | A1 * | 11/2017 | Parker | F42B 12/365 |
| 2019/0093999 | A1 * | 3/2019 | Parker | F42B 12/365 |
| 2020/0166318 | A1 * | 5/2020 | Reuther | F42B 12/38 |
| 2021/0108905 | A1 * | 4/2021 | Sullivan | F42B 12/78 |
| 2023/0194225 | A1 * | 6/2023 | Pedicini | F42C 11/001 102/501 |

FOREIGN PATENT DOCUMENTS

| | | | |
|---|---|---|---|
| WO | 2013133854 | A1 | 9/2013 |
| WO | 2022013522 | A1 | 1/2022 |

OTHER PUBLICATIONS

GB Search Report under Section 17(5) received for GB Application No. 2010965.8, dated Dec. 14, 2020. 3 pages.

Extended European Search Report received for EP Application No. 20275120.2, dated Dec. 21, 2020. 7 pages.

* cited by examiner

NON-INCENDIARY TRACERS

TECHNICAL FIELD

Aspects relate, in general, to non-incendiary tracer rounds.

BACKGROUND

Tracers are projectiles that, when fired, provide a visible trajectory to enable the flight path of the projectile to be determined. The visible trajectory thus enables a user to visualise the path of the projectile, and to make ballistic alterations so as to correct the flight path and thus ultimately the end impact point of the projectile. A tracer round will typically comprise a pyrotechnic composition that is ignited when the round is fired. The composition is such that the visible trajectory can be seen by the naked eye in daylight as well as night-time.

SUMMARY

According to an example, there is provided a non-incendiary tracer projectile structure for housing an electrically powered illumination source, the tracer projectile structure comprising a jacket comprising a generally pointed forward end and a generally blunt rearward end defining a rear opening, an internal retaining structure disposed towards the rearward end of the jacket to support a protective window that is transparent to a selected electromagnetic wavelength, wherein a portion of the rearward end of the jacket tapers in a radially inward direction whereby to define a circumferential narrowing of the rear opening so configured as to mechanically protect the internal retaining structure. The internal retaining structure can comprise a circumferentially continuous collar on an internal surface of the jacket. The internal retaining structure can comprise multiple radially inwardly projecting protrusions. The internal retaining structure can comprise a circumferential channel in an internal surface of the jacket. The internal retaining structure can comprise multiple circumferential channel portions in an internal surface of the jacket. The multiple circumferential channel portions can be arranged in the same plane.

In an example, the non-incendiary tracer projectile structure can comprise a second internal retaining structure disposed towards the rearward end of the jacket, the second internal retaining structure being axially displaced from the internal retaining structure whereby to define a channel to receive the protective window. The second internal retaining structure can comprise a circumferentially continuous collar on an internal surface of the jacket. The second internal retaining structure can comprise multiple radially inwardly projecting protrusions. The second internal retaining structure can comprise a circumferential channel in an internal surface of the jacket. The second internal retaining structure can comprise multiple circumferential channel portions in an internal surface of the jacket. The multiple circumferential channel portions can be arranged in the same plane. The second internal retaining structure can be displaced, in an axial direction, from the internal retaining structure towards the forward end of the jacket. The second internal retaining structure can be displaced, in an axial direction, from the internal retaining structure towards the rear opening. The internal retaining structure can be disposed on the portion of the rearward end of the jacket. The internal retaining structure can be disposed above, in an axial direction, the portion of the rearward end of the jacket. The second internal retaining structure can be disposed on the portion of the rearward end of the jacket.

According to an example, there is provided a tracer projectile comprising a non-incendiary tracer projectile structure as provided herein, in which the non-incendiary tracer projectile structure is partially provided in a cartridge configured to store a pyrotechnic composition.

BRIEF DESCRIPTION OF THE DRAWINGS

Embodiments will now be described, by way of example only, with reference to the accompanying drawings, in which.

DESCRIPTION

Figure 2:
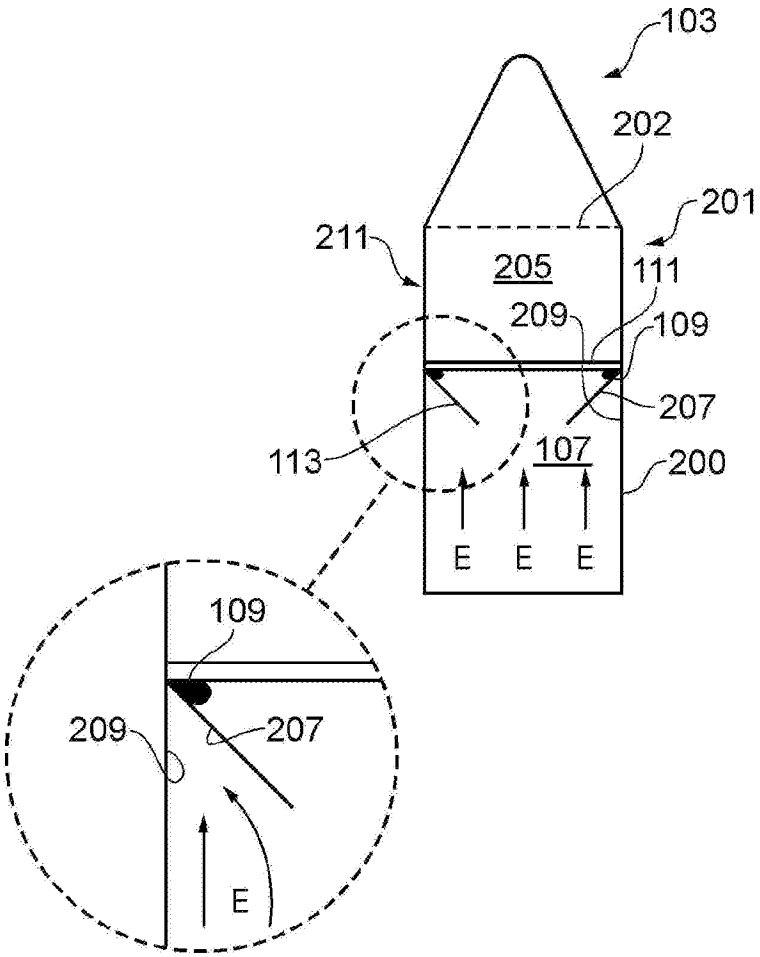
FIGS. 1 to 7 are schematic representations of a non-incendiary tracer projectile structure according to examples.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

The use of pyrotechnic compositions in incendiary tracers means that the location of the shooter can easily be determined by simple visual inspection of the starting point of the visible path that has been caused by ignition of the pyrotechnic agent in question. This can be detrimental to a user if there are hostile observers in the vicinity. Furthermore, since the pyrotechnic composition is gradually exhausted as the tracer is in flight, the trajectory will alter in a manner that is different to that of non-tracer projectiles. The reliability of pyrotechnic tracers can be lowered due to tolerances and environmental factors when creating/processing pyrotechnic chemical ingredients during manufacture, and also when stored and operated in environments with higher humidity (i.e. delayed chemical reaction or in some cases none at all when fired). Furthermore, use of pyrotechnic tracers in hot operational environments can create unintentional fires, causing collateral damage.

Non-incendiary tracers can use a rearwardly directed illumination source that is configured to emit light as the tracer is in flight. The extreme conditions present at the point that the tracer is fired mean that enormous stresses are placed on the light source and associated electronics and power source. There is also an increased risk of failure because exhaust gases present at the point of firing can exert massive pressures on the part of the tracer housing the light source.

According to an example, there is provided a non-incendiary tracer projectile structure for housing an electrically powered illumination source. The tracer projectile structure comprises a jacket comprising a generally pointed forward end and a generally blunt rearward end defining a rear opening. The rear opening can define an aperture which enables the illumination source to emit light from the structure. In an example, an internal retaining structure is disposed towards the rearward end of the jacket to support a protective window that is transparent to a selected electromagnetic wavelength. That is, a protective window can be provided in or near the aperture. The window can be transparent to a selected wavelength that corresponds to the wavelength of light emitted by the illumination source. For example, the illumination source may be configured to emit in the infra-red region of the EM spectrum. Accordingly, a material for the window can be selected to enable transmission of infra-red at the selected wavelength. The material may substantially block (that is, not transmit) other wavelengths, such as those in the visible region of the EM spectrum for example. A portion of the rearward end of the jacket tapers in a radially inward direction whereby to define a circumferential narrowing of the rear opening so configured as to mechanically protect the internal retaining structure.

Figure 1:
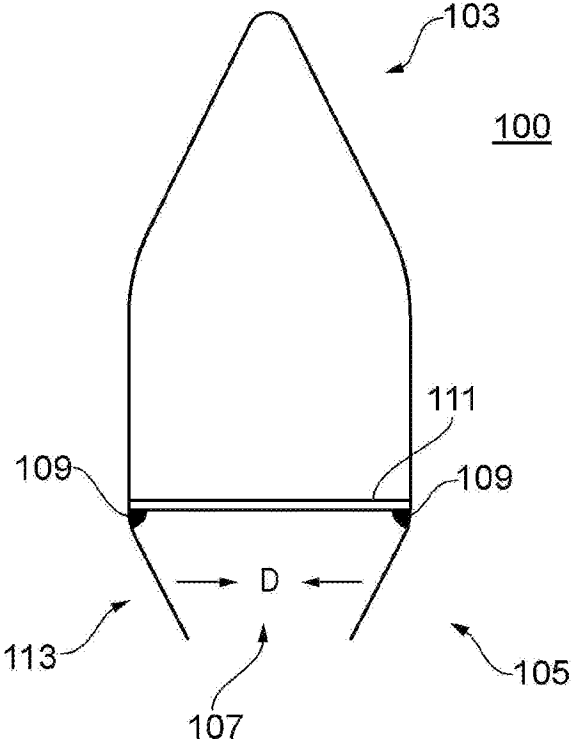

FIG. 1 is a schematic representation of a non-incendiary tracer projectile structure according to an example. In the example of FIG. 1, the comprises a jacket 100 comprising a generally pointed forward end 103 and a generally blunt rearward end 105. As noted above, the rearward end 105 defines a rear opening 107. An internal retaining structure 109 is disposed towards the rearward end 105 of the jacket 100 to support a protective window 111 that is transparent to a selected electromagnetic wavelength. A portion 113 of the rearward end 105 of the jacket 100 tapers in a radially inward direction (D) whereby to define a circumferential narrowing of the rear opening 107 so configured as to mechanically protect the internal retaining bead 109. In an example, the protective window 111 may comprise Polycarbonate, Sapphire, Fused Quartz, Laminated Toughened Glass.

FIG. 2 is a schematic representation of a non-incendiary tracer projectile structure according to an example. In the example of FIG. 2, the structure as described with reference to FIG. 1 is shown in combination with a cartridge 200. The cartridge is used to house a propellant and a primer that are used to eject the tracer projectile structure from a firing apparatus (such as a gun for example). The cartridge 200 does not form part of the present projectile structure but is described with reference to FIG. 2 in order to explain a function of the circumferential narrowing of the rear opening 107. During manufacture, the bottom cartridge 200 of the tracer (encompassing the propellant and primer) covers the majority of the tracer up to approximately the horizontal line 202 at the base of the nose 103. During firing, the cartridge 200 will be expelled, leaving the tracer and nothing obstructing the window 107 during flight. In combination, the tracer projectile structure and cartridge form a tracer projectile.

The circumferential narrowing 113 of the rear opening 107 forms a 'boat-tail' feature. Exhaust gases that are produced as a by-product of the firing of a tracer are produced as the primer ignites the propellant. That is, as the propellant burns it generates gases—the sudden, high pressure of this gas that is produced ejects the tracer projectile from the end 201 of the cartridge 200. It is forced down e.g. the barrel of the firing apparatus at high speed (of the order of several hundred m/s). The cartridge 200 remains in the firing apparatus for ejection. The boat-tail feature 113 of the tracer projectile structure protects the internal retaining structure 109, along with the window 111 and any components in the internal section 205 of the jacket 200 from the action of the exhaust gases. It also protects any sealing mechanism used in conjunction with the internal retaining structure 109. For example, adhesive may be used to seal the window to the internal retaining structure 109. Such a seal may fail under normal circumstances as a result of the action of the exhaust gases. The boat-tail feature provides protection by deflecting a proportion of the exhaust gases towards the outside surface 207 of the projectile structure. For example, with reference to FIG. 2, exhaust gases moving in direction E are deflected around the boat-tail feature of the structure towards a region defined by the outer surface 207 of the rearward end 105 of the structure and the internal surface 209 of the cartridge 200. As the pressure increases as a result of the build-up in the amount of gas produced by the propellant, the frangible connection 211 between cartridge and the projectile structure is broken and the tracer is ejected. The continuing action of the exhaust gas as the tracer is in an ejection phase, and specifically its effect on the retaining structure, is mitigated by the boat-tail feature as the tracer is ejected from the firing apparatus.

Figure 3:
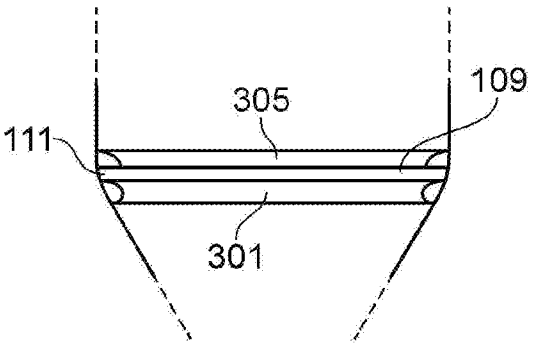

FIG. 3 is a schematic representation of a non-incendiary tracer projectile structure according to an example. In the example of FIG. 3, an internal retaining structure 109 is depicted in greater detail in a side on cut away view. In the example of FIG. 3, the retaining structure 109 comprises a circumferentially continuous collar 301 on an internal surface 303 of the jacket 100. The window 111 can be provided on the collar, and a seal 305 may be provided to adhere/seal the window to an inner surface of the jacket 100. In the example of FIG. 3, the seal 305 is provided above the window III, but may be provided below such as at the interface between the window 111 and the retaining collar 301, or in both locations.

Figure 4:
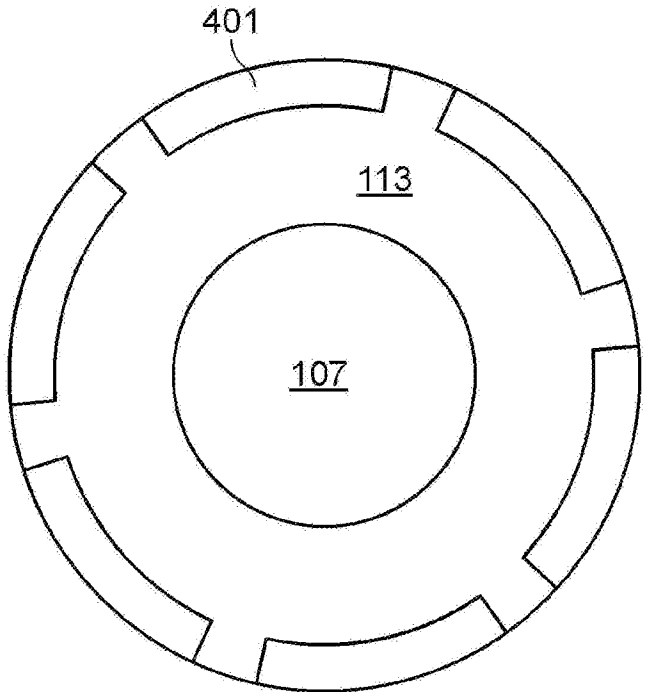

FIG. 4 is a schematic representation of a non-incendiary tracer projectile structure according to an example. In the example of FIG. 4, an internal retaining structure 109 is depicted in greater detail in plan view. In the example of FIG. 4, the retaining structure 109 comprises multiple radially inwardly projecting protrusions 401. The window 111 can be provided on the protrusions 401, and a seal 305 may be provided to adhere/seal the window to an inner surface of the jacket 100.

Figure 5:
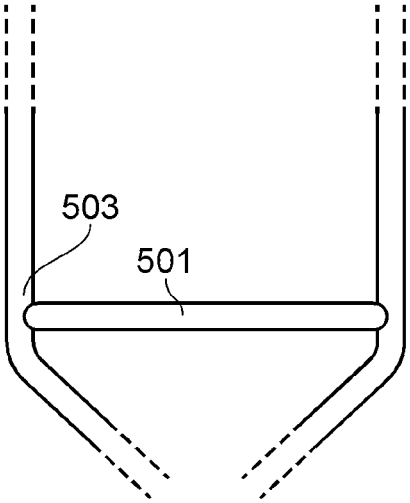

FIG. 5 is a schematic representation of a non-incendiary tracer projectile structure according to an example. In the example of FIG. 5, an internal retaining structure 109 is depicted in greater detail in a cut away side view. In the example of FIG. 5, the retaining structure 109 comprises a circumferential channel 501 in an internal surface 503 of the jacket 100. The window 111 can be provided in the channel 501, and a seal 305 (or seals) may be provided to adhere/seal the window to an inner surface of the jacket 100.

Figure 6:
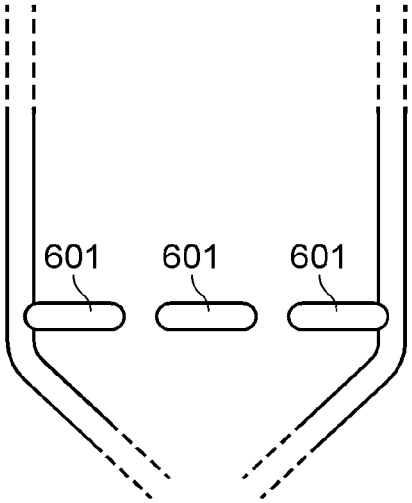

FIG. 6 is a schematic representation of a non-incendiary tracer projectile structure according to an example. In the example of FIG. 6, the internal retaining structure comprises multiple circumferential channel portions 601 in an internal surface of the jacket. The portions 601 may be arranged in the same plane or in different planes. That is, multiple circumferential rows of channels may be provided, each row being offset, in an axial direction, from one another. The window may have multiple circumferential protrusions arranged to complement the multiple channels. That is, the protrusions of the window may be so arranged as to engage into channels in the jacket whereby to enable the window to be fixedly mounted within the jacket.

According to an example, the non-incendiary tracer projectile structure can further comprise a second internal retaining structure disposed towards the rearward end of the jacket.

Figure 7:
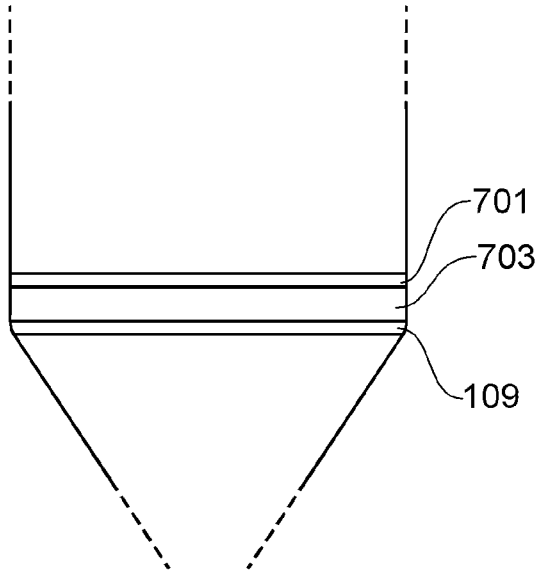

FIG. 7 is a schematic representation of a non-incendiary tracer projectile structure according to an example. In the example of FIG. 7, the second internal retaining structure 701 is axially displaced from the internal retaining structure 109 whereby to define a channel 703 to receive the protective window. The channel in the example of FIG. 7 is defined by way of the retaining structures rather than being provided within the inner wall of the jacket as in the example of FIG. 5 for example. The second internal retaining structure 701 may comprise a circumferentially continuous collar on an internal surface of the jacket, or may be composed of multiple radially inwardly projecting protrusions, similarly to other examples described above. Alternatively, the second internal retaining structure 701 may comprise a circumferential channel in an internal surface of the jacket, or multiple circumferential channel portions in an internal surface of the jacket. The multiple circumferential channel portions can be arranged in the same plane such that they form an annular band of channel portions, or in different planes (in an axial direction) from one another, thereby forming more than one annular band of channel portions.

In an example, the second internal retaining structure may be displaced, in an axial direction, relative to the internal retaining structure towards the forward or rearward end of the jacket, that is away from or towards the rear opening. The internal retaining structure can be disposed on the portion of the rearward end of the jacket. That is, the internal retaining structure can be disposed on the portion of the jacket that narrows to form the boat-tail feature. Alternatively, the internal retaining structure can be disposed above, in an axial direction, that (narrowing) portion of the rearward end of the jacket. Similarly, the second internal retaining structure can be disposed on the narrowing portion of the rearward end of the jacket.

The present inventions can be embodied in other specific apparatus and/or methods. The described embodiments are to be considered in all respects as illustrative and not restrictive. In particular, the scope of the invention is indicated by the appended claims rather than by the description and figures herein. All changes that come within the meaning and range of equivalency of the claims are to be embraced within their scope.

The invention claimed is:

1. A non-incendiary tracer projectile structure for housing an electrically powered illumination source, the tracer projectile structure comprising:

a jacket comprising a generally pointed forward end and a generally blunt rearward end defining a rear opening;

a protective window that is transparent only to a selected electromagnetic wavelength emitted by the electrically powered illumination source, and an internal retaining structure disposed towards the rearward end of the jacket to support the protective window, wherein a portion of the rearward end of the jacket tapers in a radially inward direction to define a circumferential narrowing of the rear opening.

2. The non-incendiary tracer projectile structure of claim 1, wherein the internal retaining structure comprises a circumferentially continuous collar on an internal surface of the jacket.

3. The non-incendiary tracer projectile structure of claim 1, wherein the internal retaining structure comprises multiple radially inwardly projecting protrusions.

4. The non-incendiary tracer projectile structure of claim 1, wherein the internal retaining structure comprises a circumferential channel in an internal surface of the jacket.

5. The non-incendiary tracer projectile structure of claim 1, wherein the internal retaining structure comprises multiple circumferential channel portions in an internal surface of the jacket.

6. The non-incendiary tracer projectile structure of claim 5, wherein the multiple circumferential channel portions are arranged in the same plane.

7. The non-incendiary tracer projectile structure of claim 1, wherein the internal retaining structure is a first internal retaining structure, the tracer projectile structure further comprising a second internal retaining structure disposed towards the rearward end of the jacket, the second internal retaining structure being axially displaced from the first internal retaining structure to define a channel to receive the protective window.

8. The non-incendiary tracer projectile structure of claim 7, wherein the second internal retaining structure comprises a circumferentially continuous collar on an internal surface of the jacket.

9. The non-incendiary tracer projectile structure of claim 7, wherein the second internal retaining structure comprises multiple radially inwardly projecting protrusions.

10. The non-incendiary tracer projectile structure of claim 7, wherein the second internal retaining structure comprises a circumferential channel in an internal surface of the jacket.

11. The non-incendiary tracer projectile structure of claim 7, wherein the second internal retaining structure comprises multiple circumferential channel portions in an internal surface of the jacket.

12. The non-incendiary tracer projectile structure of claim 11, wherein the multiple circumferential channel portions are arranged in the same plane.

13. The non-incendiary tracer projectile structure of claim 7, wherein the second internal retaining structure is displaced, in an axial direction, from the first internal retaining structure towards the forward end of the jacket.

14. The non-incendiary tracer projectile structure of claim 7, wherein the second internal retaining structure is displaced, in an axial direction, from the first internal retaining structure towards the rear opening.

15. The non-incendiary tracer projectile structure of claim 1, wherein the internal retaining structure is disposed on the portion of the rearward end of the jacket.

16. The non-incendiary tracer projectile structure of claim 1, wherein the internal retaining structure is disposed forward of, in an axial direction extending from the rearward end to the forward end, the portion of the rearward end of the jacket.

17. The non-incendiary tracer projectile structure of claim 7, wherein the second internal retaining structure is disposed on the portion of the rearward end of the jacket.

18. The non-incendiary tracer projectile structure of claim 1, in which the non-incendiary tracer projectile structure is partially provided in a cartridge configured to store a pyrotechnic composition.

19. A non-incendiary tracer projectile structure for housing an electrically powered illumination source, the tracer projectile structure comprising:

a jacket comprising a forward end and a rearward end defining a rear opening;

a protective window within the jacket and that is transparent to a selected electromagnetic wavelength emitted by the electrically powered illumination source;

an internal retaining structure disposed towards the rearward end of the jacket to support the protective window, wherein a portion of the rearward end of the jacket tapers in a radially inward direction to define a circumferential narrowing of the rear opening, wherein the internal retaining structure comprises a circumferential channel in an internal surface of the jacket or a circumferentially continuous collar on an internal surface of the jacket, and the protective window is in the channel or on the collar; and a seal to adhere the protective window to an inner surface of the jacket.

20. A non-incendiary tracer projectile structure for housing an electrically powered illumination source, the tracer projectile structure comprising:

a jacket comprising a forward end and a rearward end defining a rear opening;

a protective window within the jacket and that is transparent to a selected electromagnetic wavelength emitted by the electrically powered illumination source; and an internal retaining structure disposed towards the rearward end of the jacket to support the protective window, wherein a portion of the rearward end of the jacket tapers in a radially inward direction to define a circumferential narrowing of the rear opening, wherein the internal retaining structure comprises multiple circumferential channel portions in an internal surface of the jacket, and the protective window is configured with multiple circumferential protrusions arranged to fixedly engage into the multiple channel portions.

* * * * *